US007021429B2

(12) United States Patent
Hikita

(10) Patent No.: US 7,021,429 B2
(45) Date of Patent: Apr. 4, 2006

(54) ELEVATOR SYSTEM INDICATING ASSIGNED CAR

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 624 days.

(21) Appl. No.: 10/344,532

(22) PCT Filed: Jun. 25, 2001

(86) PCT No.: PCT/JP01/05418

§ 371 (c)(1),
(2), (4) Date: Feb. 12, 2003

(87) PCT Pub. No.: WO03/000579

PCT Pub. Date: Jan. 3, 2003

(65) Prior Publication Data

US 2003/0164267 A1 Sep. 4, 2003

(51) Int. Cl.
*B66B 3/02* (2006.01)

(52) U.S. Cl. ..... 187/398; 187/391

(58) Field of Classification Search ..... 187/280, 187/282, 247, 391, 393, 395–399; 116/68, 116/226

See application file for complete search history.

(56) References Cited

U.S. PATENT DOCUMENTS

| | | | | | |
|---|---|---|---|---|---|
| 4,852,696 | A | * | 8/1989 | Fukuda et al. | 187/392 |
| 4,915,197 | A | | 4/1990 | Schroder | |
| 4,989,694 | A | * | 2/1991 | Ueshima et al. | 187/380 |
| 5,300,738 | A | * | 4/1994 | Kostka et al. | 187/395 |
| 5,689,094 | A | * | 11/1997 | Friedli et al. | 187/384 |
| 5,831,226 | A | | 11/1998 | Hattori et al. | |
| 6,065,570 | A | * | 5/2000 | Friedli et al. | 187/387 |
| 6,394,231 | B1 | * | 5/2002 | Schuster et al. | 187/382 |
| 2001/0035314 | A1 | * | 11/2001 | Yoshida et al. | 187/382 |

FOREIGN PATENT DOCUMENTS

| | | | |
|---|---|---|---|
| CA | 1300771 | | 11/1992 |
| JP | 60-77078 | | 5/1985 |
| JP | 61-75777 | | 4/1986 |
| JP | 63-202577 | | 8/1988 |
| JP | 01-203189 | | 8/1989 |
| JP | 06144726 | A * | 5/1994 |
| JP | 9-315708 | | 12/1997 |
| JP | 2000-272850 | | 10/2000 |
| JP | 2001-302118 | | 10/2001 |
| JP | 2001-348170 | | 12/2001 |
| WO | WO 01/79101 | | 10/2001 |

* cited by examiner

*Primary Examiner*—Jonathan Salata
(74) *Attorney, Agent, or Firm*—Leydig, Voit & Mayer, Ltd.

(57) ABSTRACT

An elevator system includes a hall operation panel in an elevator hall and from which a destination floor is input; a group control which assigns a car to be stopped at the destination floor input from the hall operation panel; hall lanterns in the elevator hall for respective cars and informing passengers of assigned cars; and destination floor indicators in the elevator hall for respective cars and indicating destination floors, so that when a destination floor is input from the hall operation panel, the hall lantern corresponding to a car assigned by the group control is lit, and the destination floor indicator corresponding to the car assigned by the group control indicates the destination floor. As a result, the passenger can ascertain at a glance the car he is to get on and always be sure of the car he is to get on until the car arrives, so that the passenger is advantageously enabled to wait for the arrival of the car without experiencing any anxiety.

14 Claims, 5 Drawing Sheets

PRIOR ART

ELEVATOR SYSTEM INDICATING ASSIGNED CAR

TECHNICAL FIELD

The present invention relates to an elevator system which receives information on a destination floor, which is inputted by a passenger in an elevator hall, and informs the passenger of an assigned car corresponding to this destination floor, guiding the passenger to the car which he is to get in.

BACKGROUND ART

Generally speaking, in an elevator hall where a plurality of elevators are provided side by side, call buttons called up/down buttons and hall lanterns for respective cars are provided in many cases. In this hall system, when the passenger depresses an up or down call button, an assigned car is immediately selected by a group control unit and the hall lantern of the corresponding assigned car is lit to let the passenger know which car to take. In this system, the command regarding the destination floor for the passenger is input within the car after the passenger has got on it.

In this system, a number of passengers with different destination floors get on the same car, and the number of times that the car stops is inevitably large. Thus, it takes a long time for the car having left, for example, the first floor, to return thereto, which is disadvantageous from the viewpoint of transportation efficiency.

In view of this, there has recently been proposed a system in which the destination floor is input at the elevator hall, the passenger being informed of an assigned car selected on the basis of the input. In this system, a car is assigned and selected with the destination floor being known, so that it is possible to perform, as much as possible, group control such that passengers whose destinations are the same are let on the same car. As a result, it is possible to substantially reduce the number of times that each car stops, thereby achieving an improvement in terms of transportation efficiency as compared with the system in which up/down buttons allowing the passengers to exclusively register directions of their destination floors are adopted.

Examples of such a system, in which the passenger is informed of a car assigned and selected for each destination floor input at the elevator hall, are disclosed, for example, in JP 9-315708 A (hereinafter referred to as the prior-art technique (a)) and JP 2563545 B (hereinafter referred to as the prior-art technique (b)).

First, FIGS. 4(*a*) and 4(*b*) schematically show the prior-art technique (a). This system is composed of an elevator hail operation panel 100 having destination floor buttons 101 allowing input of a destination floor at the elevator hail and display panels 102 displaying the destination of each car in a zone form.

FIGS. 5(*a*) and 5(*b*) schematically show the prior-art technique (b). In this system, there is provided in the elevator hall a hall operation panel 200, on which there are provided a keyboard 201 for inputting a destination floor and a display panel 202. When the passenger operates the keyboard 201 to input a destination floor, destination floor information 203 as input is displayed on the display panel 202. At the same time, assigned car information 204 informing of an assigned car selected by a group control unit in correspondence with the destination floor is displayed on the display panel 202. For the assigned car information 204, a car name corresponding to a car name plate 210 provided on each car is used. Further, there is displayed, at the same time, position indicator information 204, 205 indicating on which side of the ball operation panel operated the assigned car exists.

FIGS. 4(*a*), 4(*b*), 5(*a*) and 5(*b*), which are conceptual drawings, differ from the original drawings of the above-mentioned publications. Similarly, reference numerals in these drawings are used as appropriate.

In the prior-art technique (a), the assigned-car selection for each destination floor is restricted to the zone form. Thus, when, for example, passengers going to the fifth, eighth, ninth, and tenth floor come to the elevator hall, several passengers for each floor, it is necessary for the car on the left-hand side in FIG. 4 to stop at three floors: the eighth, ninth, and tenth floors, whereas the car on the right-hand side only stops at the fifth floor, resulting in variation between the right and left cars. Generally speaking, in group control, it is desirable that the burden on each car is uniform from the viewpoint of transportation efficiency. In this system, however, it is not always possible to realize evenness in burden, resulting in a deterioration in transportation efficiency.

Regarding this problem, the prior-art technique (b) proves effective. For example, it is possible to assign the fifth and eighth floors to the left-hand side car A and the ninth and tenth floors to the right-hand side car B, thus making it possible to effect assigned-car selection more flexibly than in the prior-art technique (a). This system, however, only indicates on which side of the designation/registration/display device the selected assigned car exists. When, for example, there exist eight cars or so, a plurality of cars exist on either side of the device, which means it is impossible to identify a car from the assigned-car position indicator information alone.

Further, the display of the assigned-car information 204 on the display panel 202 is erased when the next passenger operates the operation panel. Thus, the passenger has to remember the car name until the assigned car in question arrives, which leads to a problem that, in some cases, the passenger experiences anxiety.

The present invention has been made with a view toward solving the above-mentioned problems in the prior art. It is an object of the present invention to provide an elevator system which enables the passenger to identify the assigned car at a glance and which is capable of guiding the passenger so that he can get on the designated car without experiencing any anxiety.

DISCLOSURE OF THE INVENTION

An elevator system according to the present invention is characterized in that the system includes: a hall operation panel which is provided in an elevator hall and from which a destination floor is input; a group control means which assigns a car to be stopped at the destination floor input from the hall operation panel; a plurality of hall lanterns provided in the elevator hall for respective cars and adapted to inform of assigned cars; and a plurality of destination floor indicators provided in the elevator hall for respective cars and adapted to indicate destination floors, wherein when a destination floor is input from the hall operation panel, the hall lantern corresponding to a car assigned by the group control means is lit, and the destination floor indicator corresponding to the car assigned by the group control means indicates the destination floor.

Also, it is preferable that the hall operation panel is provided with a display panel which displays at least one of the input destination floor and the car assigned by the group control means.

Further, it is preferable that the display on the display panel is erased after a fixed period of time has elapsed.

Also, it is preferable that the hall lanterns effect arrival display whenever a car arrives.

Further, it is preferable that each of the hall lanterns has a car name plate indicating the name of the corresponding car, the car name plate being lit or extinguished in accordance with the informing or call-cancel of the assigned car.

BEST MODE FOR CARRYING OUT THE INVENTION

An embodiment of the present invention will now be described with reference to the accompanying drawings.

Figure 1:
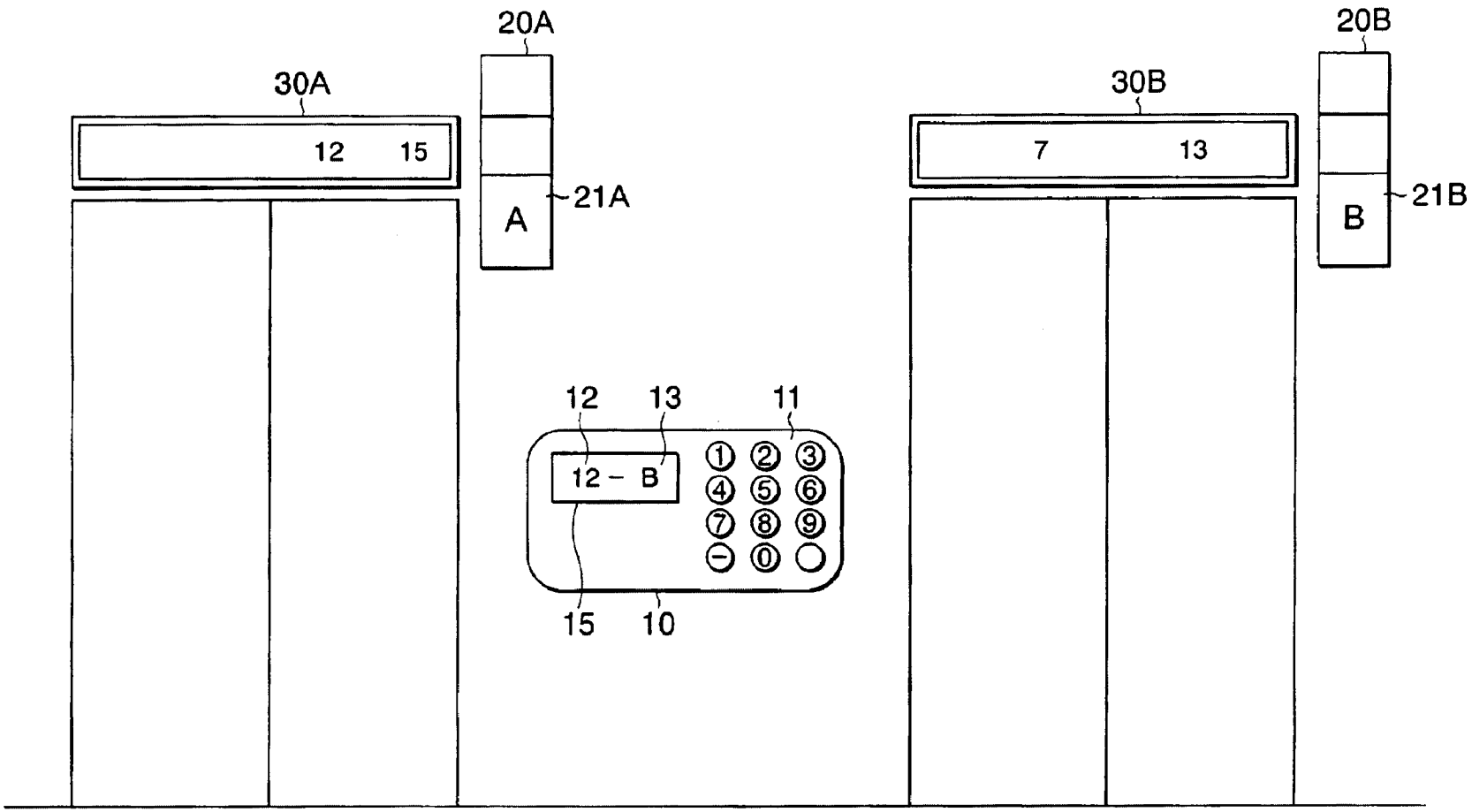
FIG. 1 is a diagram schematically illustrating an elevator hall of an elevator system according to an embodiment of the present invention.

FIG. 1 is a diagram schematically illustrating an elevator hall of an elevator system according to an embodiment of the present invention. In FIG. 1, reference numeral 10 indicates a hall operation panel for registering a destination floor at the elevator hall. Arranged on the hall operation panel 10 are a keyboard 11 for inputting the destination floor and a display panel 15. The display panel 15 displays destination floor information 12 as input and assigned-car information 13 on a car selected in correspondence with the destination floor.

Reference symbols 20A and 20B indicate hall lanterns respectively corresponding to car A (the left-hand side car) and car B (the right-hand side car) and adapted to enable, through flickering or chime sound, the passenger to know that the car in question has become the assigned car. Reference symbol 21A indicates a car name plate incorporated into the hall lantern 20A and adapted to be lit/extinguished in synchronism with the hall lantern 20A. Reference symbols 30A and 30B indicate destination floor indicators indicating the floors on which cars A and B are to stop.

Figure 2:
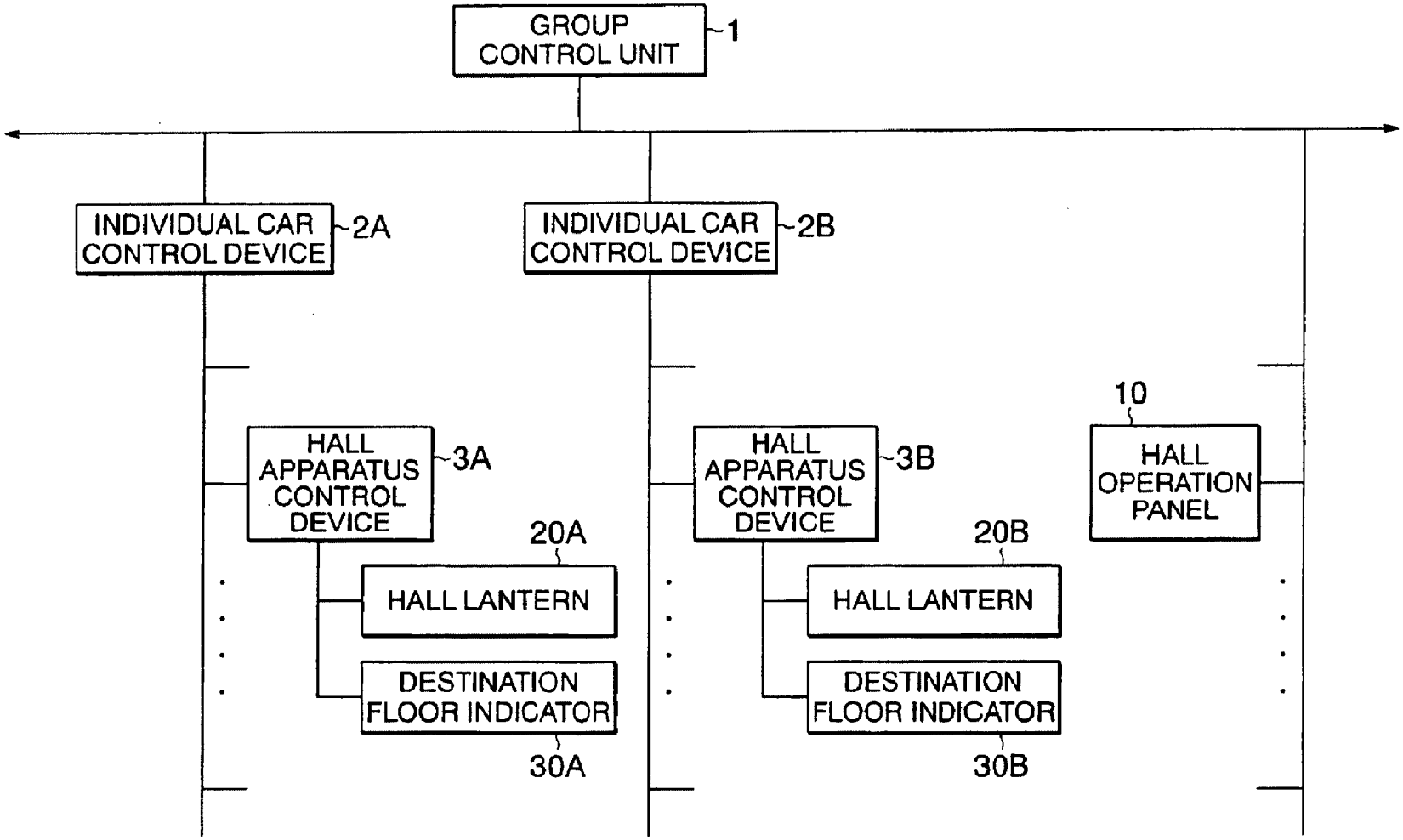
FIG. 2 is a block diagram showing the construction of an elevator system according to an embodiment of the present invention.

FIG. 2 is a block diagram showing the construction of the elevator system of this embodiment. In FIG. 2, reference numeral 1 indicates a group control unit for organically controlling a plurality of elevators, and reference symbols 2A and 2B indicate individual car control devices for controlling the respective cars. Reference symbols 3A and 3B indicate hall apparatus control devices installed in each hall and adapted to control each device in the elevator hall based on commands from the individual car control devices 2A and 2B. The hall lanterns 20A and 20B and the destination floor indicators 30A and 30B are respectively connected to the hall apparatus control devices 3A and 3B.

Further, the group control unit 1, the individual car control devices 2A, 2B, . . . , and the hall apparatus control devices 3A, 3B, . . . are connected by a network, making it possible to perform mutual communication of information.

Like the up/down buttons, the hall apparatus control devices 3A and 3B are arranged between the cars. However, it is not always necessary to arrange them between all the cars; at least one hall apparatus control device arranged at each hall will provide the desired function.

Further, it is also possible for the group control unit 1 to be incorporated in, for example, one of the individual car control devices 2A, 2B, . . . .

Figure 3:
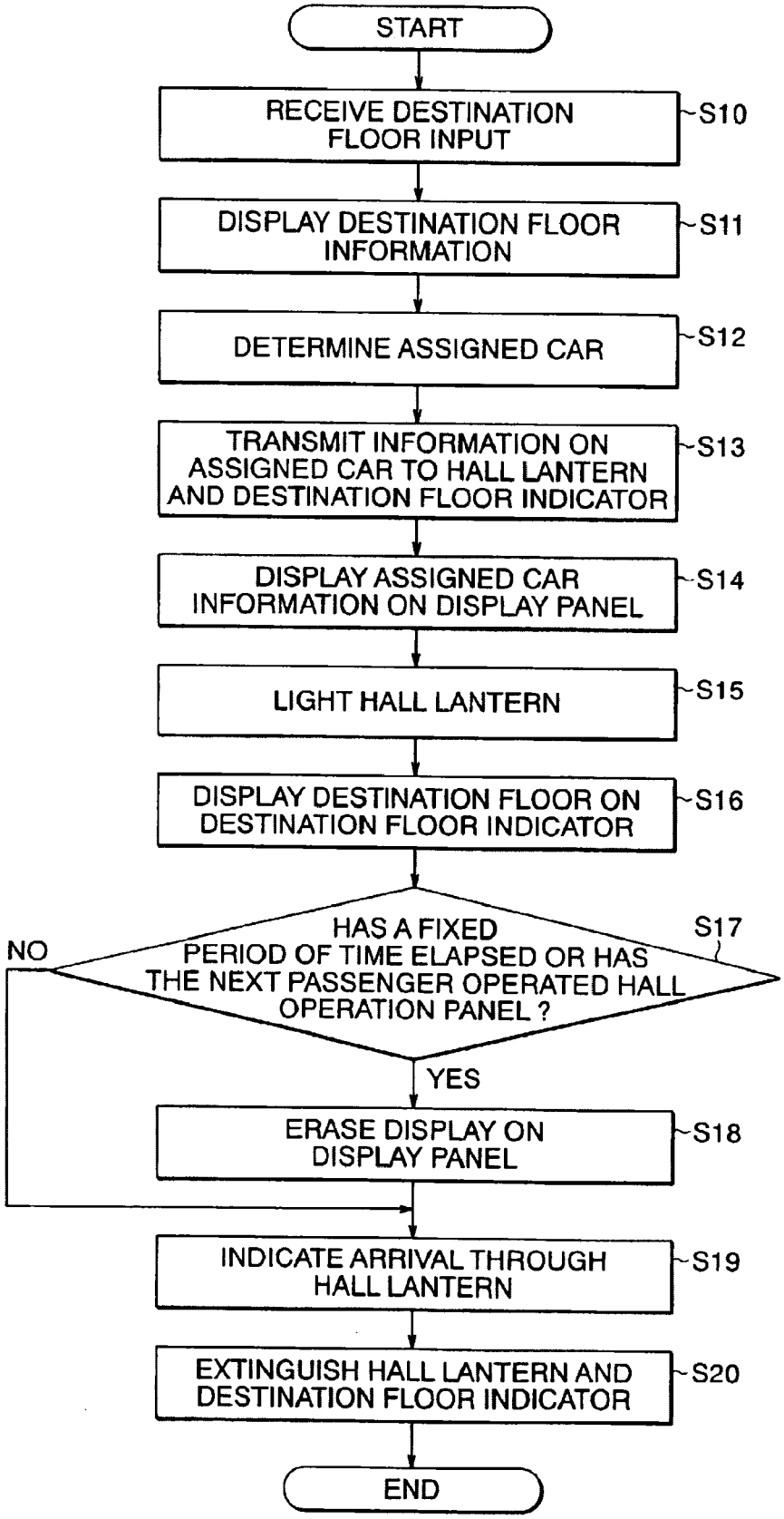
FIG. 3 is a flowchart illustrating the operation of an elevator system according to an embodiment of the present invention.
Figure 4A:
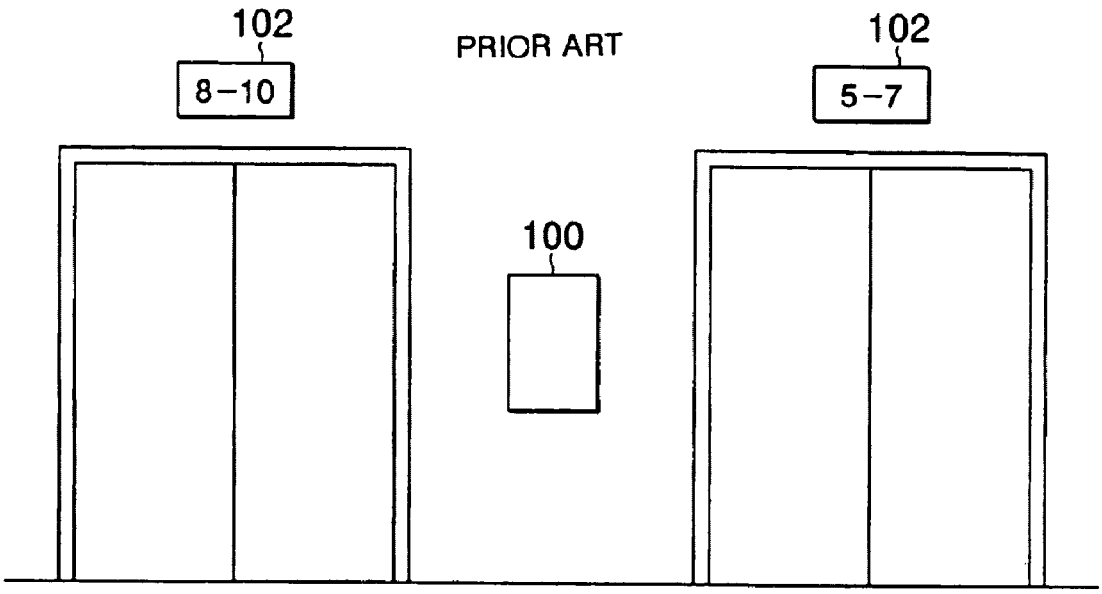
FIG. 4(*a*) is a diagram schematically illustrating an elevator hail of a conventional elevator system and FIG. 4(*b*) shows an elevator ball operating panel.
Figure 4B:
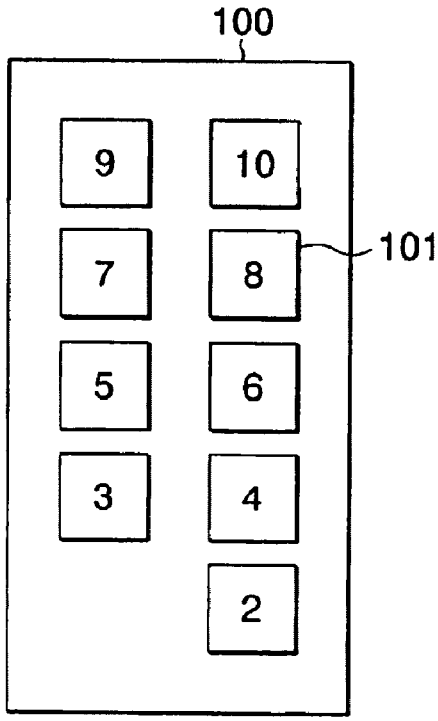
Figure 5A:
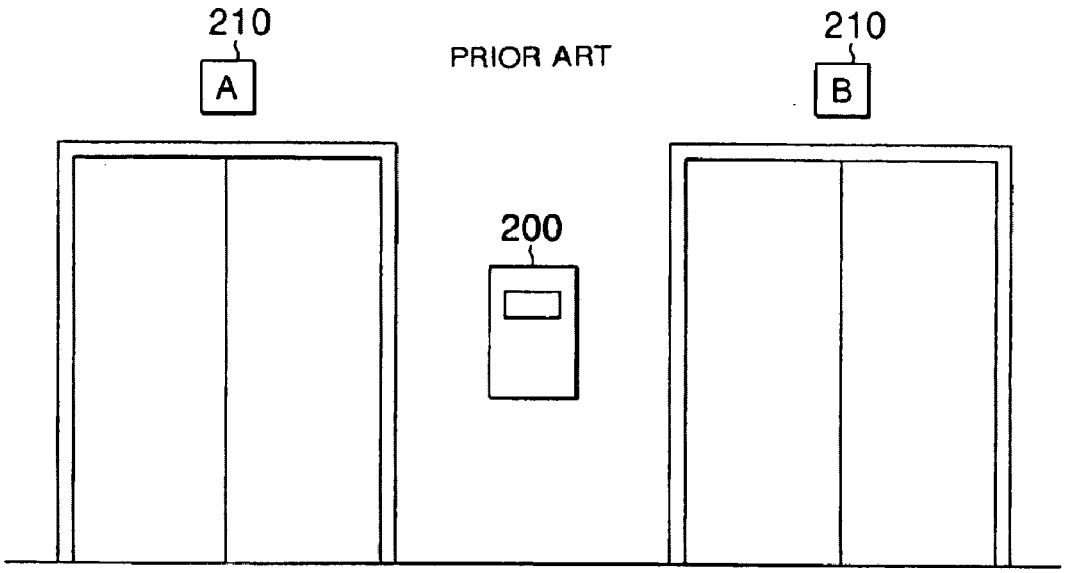
FIG. 5(a) PRIOR ART
FIG. 5(*a*) is a diagram schematically illustrating an elevator hall of another conventional elevator system and FIG. 5(*b*) shows an elevator hail operating panel.
Figure 5B:
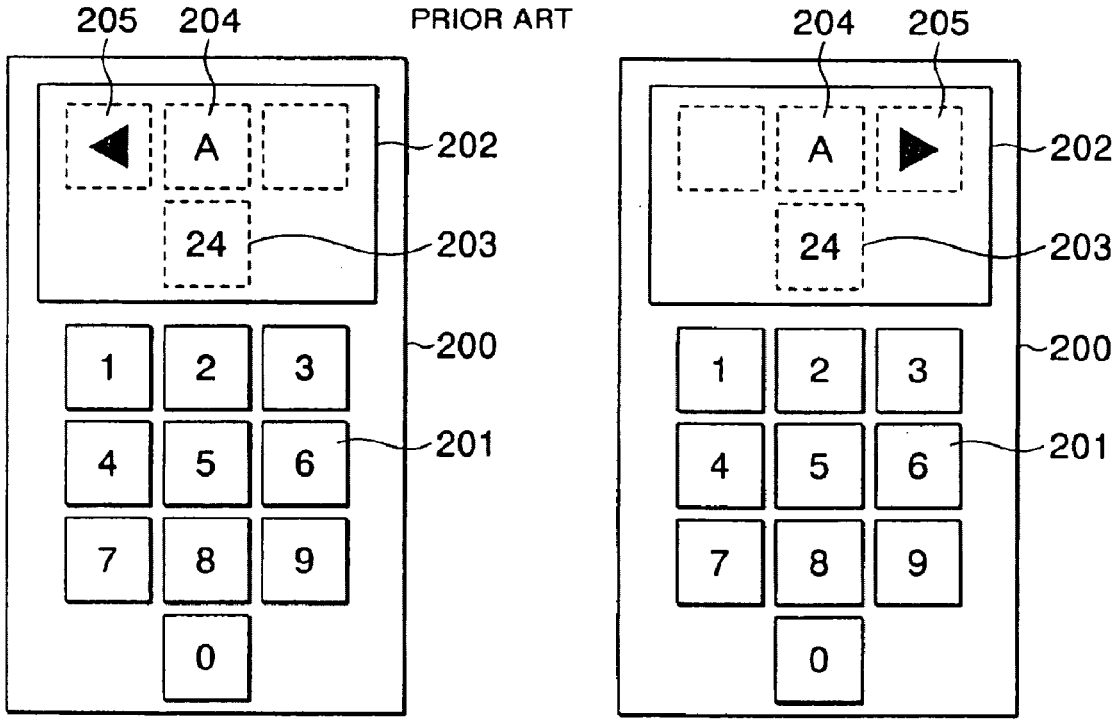
FIG. 5(b) PRIOR ART

Next, an example of the operation of this embodiment will be described with reference to the flowchart of FIG. 3.

First, when the passenger operates the keyboard 11 provided on the hall operation panel 10 to input his destination floor, the input is received (step S10) and destination floor information 12 is displayed on the display panel 15 of the hall operation panel 10 (step S11).

The destination floor information 12 is transmitted to the group control unit 1 through the network, and the group control unit 1 judges the in-building transportation condition on the basis of the information from the individual car control devices 2A, 2B, . . . and the assignment result obtained up to that time, and immediately determines an appropriate assigned car (step S12).

The information on the assigned car selected in step S12 is immediately transmitted through the network to the hall operation panel 10 where the destination floor was input. At the same time, when, for example, car A becomes the assigned car, the information is immediately transmitted to the hall lantern 20A and the destination floor indicator 30A through the individual car control device 2A and the hall apparatus control device 3A (step S13). And, the assigned-car information 13 is displayed on the display panel 15 of the hall operation panel 10 (step S14). Further, the hall lantern 20A is lit and the chime is sounded (step S15), clearly informing the passenger of the position of the assigned car. In this process, the car name plate 21A incorporated in the hall lantern 20A is also lit, and the name of the assigned car is caused to stand out among the car name plates, whereby the passenger gets a vivid impression of the assigned car.

Further, the destination floor input from the hall operation panel 10 is displayed on the destination floor indicator 30A (step S16), whereby the passenger confirms that the assigned car in his memory is surely directed to his target floor.

When, after the assigned-car information 13 is displayed on the display panel 15 of the hall operation panel 10 in step S14, a fixed time, for example, of several seconds has elapsed, or the next passenger operates the hall operation panel 10 (step S17), the display on the display panel 15 of the hall operation panel 10 is erased (step S18).

Thereafter, when the assigned car arrives, the hall lantern 20A is caused to flicker to indicate the arrival (step S19), and when the elevator starts after the passenger have got on/off, the hall lantern 20A and the destination indicator 30A are extinguished (step S20).

In this way, by the processing in step S18, the assigned-car information 13 displayed on the display panel 15 of the hall operation panel 10 is erased in a short time. However, the lighting of the hall lantern 20A effected in step S15 and the indication of the destination floor indicator 30A effected in step S16 are maintained until the car starts, so that the passenger can always ascertain the car he is to get on.

Further, the destination floor indicators 30A, 30B, . . . indicate all the destination floors that have already been input by the other passengers. Thus, when, on arriving at the elevator hall, the passenger finds his destination floor displayed on one of the car destination floor indicators 30A, 30B, . . . , there is no need to newly input the destination floor from the hall operation panel 10; the passenger has only to wait for the arrival of the car in front of the hoistway door where his destination floor is displayed.

As described above, in this embodiment, when the destination floor is input from the hall operation panel 10, the hall lantern 20A, 20B, . . . corresponding to the car assigned by the group control unit 1 is lit, and the destination floor indicator 30A, 30B, . . . corresponding to the car assigned by the group control unit 1 indicates the destination floor, so that the passenger can ascertain at a glance the car he is to get on, and can always be sure of the car he is to get on until it arrives. As a result, the passenger is advantageously enabled to wait for the arrival of the car without experiencing any anxiety.

Further, the hall operation panel 10 is provided with the display panel 15 which displays at least one of the input destination floor and the car assigned by the group control unit 1, so that it is possible for the passenger to check at a glance the destination floor he has input and the assigned car and the relationship therebetween; further, he can always be sure of the car he is to get on until the car arrives, so that it is advantageously possible to guide the passenger to the assigned car without causing him to experience any anxiety.

Further, the display panel 15 erases the display after a fixed period of time has elapsed, so that it is possible to achieve a reduction in power consumption. Further, the service life of the display panel 15 is advantageously elongated.

Further, each of the hall lanterns 20A, 20B, . . . effects arrival display when a car arrives, so that the passenger is advantageously enabled to get on a car which is to stop at the desired floor without hesitation.

Further, the hall lanterns 20A, 20B, . . . for the respective cars are provided with the electronic car name plates 21A, 21B, . . . indicating the car names, and the car name plates 21A, 21B, . . . are lit/extinguished in accordance with the informing/call-cancel of the assigned cars, so that it is advantageously possible for the passenger to have a more vivid impression of the assigned car.

INDUSTRIAL APPLICABILITY

As described above, in the elevator system of the present invention, the passenger can ascertain at a glance the car he is to get on, and can always be sure of the car he is to get on until the car arrives, so that the present invention is suitable for an elevator system in which a relatively large number of cars are controlled.

What is claimed is:

1. An elevator system comprising:

a hall operation panel located in an elevator hall serviced by a plurality of cars and which destination floors are input;

group control means which assigns cars, of the cars servicing the elevator hail, to stop at the destination floors that have been input through the hall operation panel;

a plurality of hall lanterns located in the elevator hall for respective cars servicing the elevator hall and supplying information concerning the cars servicing the elevator hall and assigned to stop at respective destination floors; and a plurality of destination floor indicators located in the elevator hall for respective cars servicing the elevator hall and indicating destination floors to be serviced by the respective cars, wherein, when a destination floor is input through the hall operation panel the hall lantern corresponding to the car assigned to stop at the destination floor by group control means is lit, and the destination floor indicator corresponding to the car assigned by the group control means indicates the destination floor.

2. The elevator system according to claim 1, wherein the hall operation panel includes a display panel which displays at least one of the input destination floor and the car assigned by the group control means.

3. The elevator system according to claim 2, wherein the display on the display panel is erased after a fixed period of time has elapsed.

4. The elevator system according to claim 1, wherein the respective hall lantern effects an arrival display whenever the corresponding car arrives at the elevator hall.

5. The elevator system according to claim 1, wherein each of the hall lanterns has a car name plate indicating name of a corresponding car, the car name plate being lit or extinguished in accordance with supplying and canceling of the assigned car.

6. The elevator system according to claim 2, wherein the respective hall lantern effects an arrival display whenever the corresponding car arrives at the elevator hall.

7. The elevator system according to claim 3, wherein the respective hall lanterns effect an arrival display whenever the corresponding car arrives at the elevator hall.

8. The elevator system according to claim 2, wherein each of the hall lanterns has a car name plate indicating name of a corresponding car, the car name plate being lit or extinguished in accordance with supplying and canceling of the assigned car.

9. The elevator system according to claim 3, wherein each of the hall lanterns has a car name plate indicating name of a corresponding car, the car name plate being lit or extinguished in accordance with supplying and canceling of the assigned car.

10. The elevator system according to claim 4, wherein each of the hall lanterns has a car name plate indicating name of a corresponding car, the car name plate being lit or extinguished in accordance with supplying and canceling of the assigned car.

11. The elevator system according to claim 1, wherein the destination floor indicator maintains an indication of the destination floor from assignment of the corresponding car to the destination floor until the car assigned arrives at the elevator hall and departs from the elevator hall.

12. The elevator system according to claim 11, wherein the destination floor indicator is extinguished when the corresponding car departs from the elevator hall.

13. The elevator system according to claim 11, wherein the destination floor indicator for a respective car maintains the indication for all the destination floors for the corresponding car, as assigned by the group control means, until the car assigned arrives at the elevator hall and departs from the elevator hall.

14. The elevator system according to claim 13, wherein the destination floor indicator is extinguished when the corresponding car departs from the elevator hall.

* * * * *